US005185994A

United States Patent [19]

Stahlecker

[11] Patent Number: 5,185,994

[45] Date of Patent: Feb. 16, 1993

[54] FEEDING AND OPENING DEVICE FOR AN OPEN-END SPINNING ARRANGEMENT

[75] Inventor: Hans Stahlecker, Haldenstrasse 20, 7334 Süssen, Fed. Rep. of Germany

[73] Assignee: Hans Stahlecker, Fed. Rep. of Germany

[21] Appl. No.: 821,565

[22] Filed: Jan. 16, 1992

[30] Foreign Application Priority Data

Jan. 18, 1991 [DE] Fed. Rep. of Germany ..... 4101315

[51] Int. Cl.[5] ..... D01H 4/32

[52] U.S. Cl. ..... 57/412; 19/105

[58] Field of Search ..... 57/408–413; 19/105

[56] References Cited

U.S. PATENT DOCUMENTS 3,335,558 8/1967 Doudlebsky et al. ..... 57/412

3,826,071 7/1974 Grau ..... 57/412 X 3,938,310 2/1976 Didek et al. ..... 57/412

4,024,699 5/1977 Goldammer et al. ..... 57/412

FOREIGN PATENT DOCUMENTS 0291711 11/1988 European Pat. Off. .

2460043 6/1976 Fed. Rep. of Germany .

*Primary Examiner*—Joseph J. Hail, III

*Attorney, Agent, or Firm*—Evenson, Wands, Edwards, Lenahan, McKeown

[57] ABSTRACT

In the case of a feeding and opening device for an open-end spinning arrangement having a tuft support, which follows a feeding table, it is provided that the tuft support is arranged stationarily and has a guiding surface which is situated opposite a feeding roller, extends approximately radially with respect to the opening roller and continues the clamping surface of the feeding table.

14 Claims, 2 Drawing Sheets

FEEDING AND OPENING DEVICE FOR AN OPEN-END SPINNING ARRANGEMENT

BACKGROUND AND SUMMARY OF THE INVENTION

This invention relates to a feeding and opening device for an open-end spinning arrangement, having a feeding roller and a movable feeding table which has a feeding surface which forms a clamping point together with the feeding roller, and having a tuft support which follows the feeding table and has a supporting surface for a tuft which is situated opposite a mounting of an opening roller.

In the case of the feeding and opening devices used currently in practice in open-end spinning machines, the tuft support is as a rule constructed in one piece with the feeding table. The movable feeding table is pressed against the feeding roller by means of spring force, in which case it carries out movements in the radial direction to the feeding roller as a result of fluctuations in the thickness. Because of these movements, the supporting surface also shifts relative to the mounting of the opening roller.

It is also known (European Patent Document EP-A 0 291 711) to construct the feeding table and the tuft support in one piece with a housing surrounding the opening roller. In this case, it is provided that either the housing is radially movable with respect to the feeding roller or the feeding roller is movable in the circumferential direction with respect to the opening roller. Also in this case, the conditions change in the area in which the sliver with its tuft arrives in the mounting of the opening roller.

It is also known (German Patent Document DE-A 24 60 043) to provide the feeding table only with a supporting surface that is very short in the circumferential direction of the opening roller and to construct the remaining part of the supporting surface as a component of a housing surrounding the opening roller. Also in this case, the movements of the feeding table have the result that the conditions change under which the tuft is offered to the mounting of the opening roller.

It is an object of the invention to provide a feeding and opening device of the initially mentioned type in which the sliver is fed to the opening roller in a manner that always remains the same to the maximum possible extent, and the tuft is offered to the opening roller in a manner that also always remains the same to the maximum possible extent.

This object is achieved in that the tuft support is arranged stationarily and has a guiding surface which is situated opposite the feeding roller, extends approximately radially with respect to the opening roller and continues the clamping surface of the feeding table.

In the case of this construction, it is not the movable feeding table which determines the point at which the sliver arrives at the mounting of the opening roller and how the tuft is offered to the mounting. Rather, these conditions are determined by the stationary tuft support so that these conditions will also not change when the feeding table moves in order to compensate for the differences in the thickness of the sliver.

In a further development of the invention, it is provided that the tuft support is arranged to be adjustable relative to the opening roller. By means of this adjustability, the combing-out conditions may be optimized and may be kept constant during the subsequent complete spinning operation.

In a further development of the invention, it is provided that the guiding surface of the tuft support facing the feeding roller is a partial-cylinder surface which is aligned approximately coaxially with respect to the feeding roller. As a result, it is achieved that a certain clamping of the sliver is still present in the area of the guiding surface of the tuft support.

In a further development of the invention, it is provided that the supporting surface of the tuft support is provided with edge borders. By means of this measure, it is achieved that the tuft cannot escape laterally during the combing-out which could impair the combing-out.

In a further development of the invention, it is provided that the tuft support is provided with a projection projecting into the are between the feeding roller and the opening roller which has a window for the guiding-through of a sliver. As a result, the occurrence of uncontrollable air flows in the area in which the sliver is guided to the opening roller can be largely prevented.

In a further development of the invention, it is provided that a sliding gap exists between the tuft support and the movable feeding table. Because of this sliding gap, it is prevented with sufficient reliability that fibers or the like, which may interfere with the spinning operation, can be caught there. In an embodiment of the invention, it is provided that the feeding table can be swivelled about a swivel shaft which is parallel to the feeding roller, and that the surfaces of the feeding table and of the tuft support, which are situated opposite one another, extend at least approximately concentrically with respect to the swivel shaft.

Other objects, advantages and novel features of the present invention will become apparent from the following detailed description of the invention when considered in conjunction with the accompanying drawings.

DETAILED DESCRIPTION OF THE DRAWINGS

Figure 1:
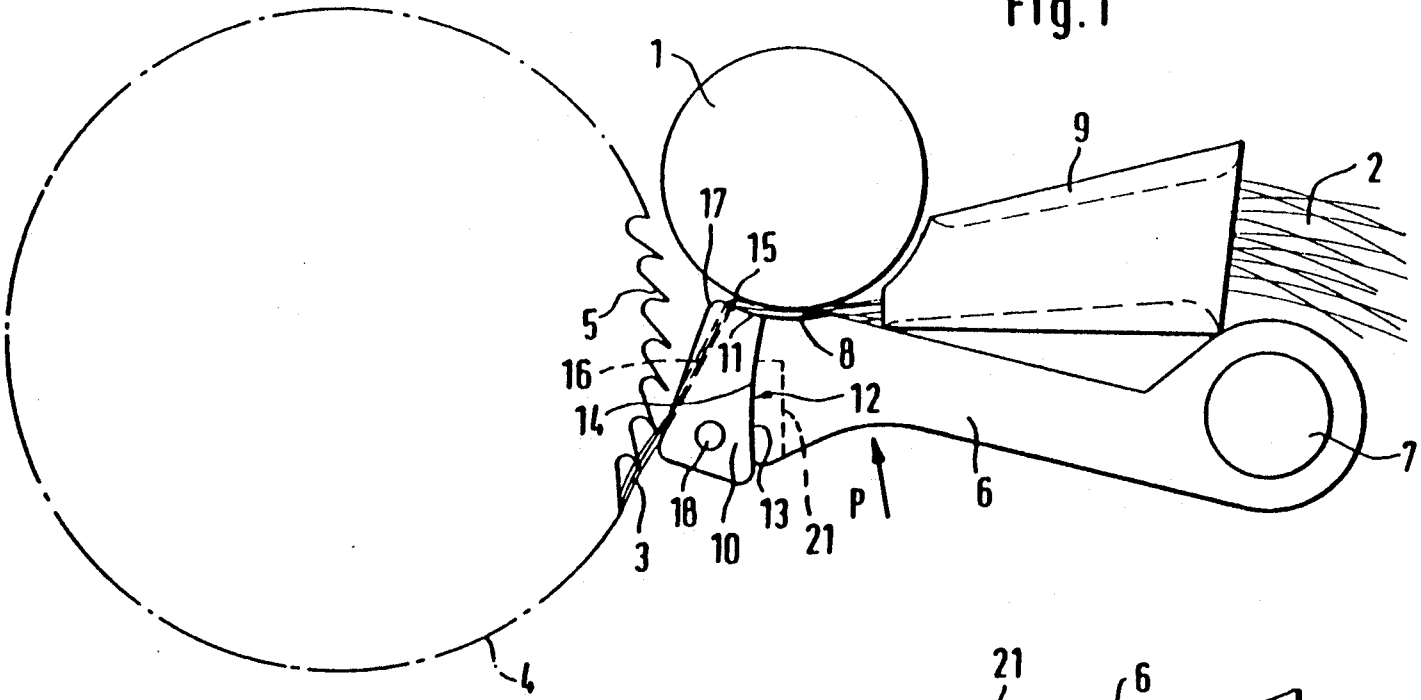
FIG. 1 is a lateral view of a somewhat schematically shown feeding and opening device constructed according to a preferred embodiment of the invention.
Figure 2:
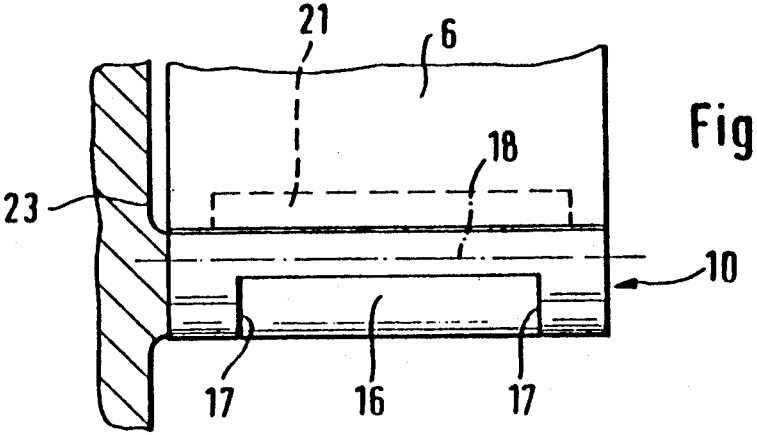
FIG. 2 is a partial top view of FIG. 1 of the feeding table and a connecting stationary tuft support.

The feeding and opening device illustrated in FIGS. 1 and 2 comprises a feeding part with a feeding roller 1, a feeding table 6 and a feeding hopper 9 which withdraw a sliver 2 from a can, which is not shown, and feed it to an opening roller 4 which follows. On its circumference, the opening roller 4 is provided with a mounting 5 of teeth or needles which combs out the end 3 of the sliver 2, the so-called tuft; that is, it pulls the fibers out of this tuft and separates them. The separated fibers are taken along by the mounting 5 of the opening roller 4 in the circumferential direction and are then transferred to a fiber feeding duct, which is not shown and in which they are guided by means of a transport air flow to a spinning element, particularly a spinning rotor. There the fibers are collected in the form of a small sliver which is twisted together by the rotation of the spinning element and is withdrawn as a yarn.

The feeding table 6 can be swivelled about a shaft 7 which is parallel to the feeding roller 1, and the feeding table 6 is loaded by means of a preferably adjustable force (P) in the direction of the feeding roller 1. The area of the feeding table 6, which is situated opposite the feeding roller 1, is constructed as a partially cylindrical guiding surface 8 acting as a clamping surface, the radius of the guiding surface 8 being adapted to the feeding roller 1. The guiding surface 8 forms a clamping point with the feeding roller 1 at which the fiber ends are held during the combing-out. The thickness of the sliver 2 may fluctuate within certain limits. These fluctuations of the thickness are compensated by the movements of the guiding surface 8 of the feeding table 6 which take place approximately radially with respect to the feeding roller 1.

The end 3 of the sliver 2, the so-called tuft, is supported during the combing-out by means of a sliver tuft support 10 which has a supporting surface 16 facing the circumference of the mounting 5 of the opening roller 4. The supporting surface 16 extends approximately tangentially with respect to the circumference of the mounting 5 so that a wedge-shaped feeding area for the end 3 of the sliver 2 is formed. The tuft support 10 has a guiding surface 11 for the sliver 2 which faces the feeding roller 1, which extends approximately concentrically with respect to the shaft of the feeding roller 1 and which changes into the supporting surface 16 by means of a rounded deflecting edge 15. The guiding surface 11 of the tuft support 10 extends approximately radially with respect to the opening roller 4, in which case it deviates from the radial direction by a relatively slight angle and is set against the rotating direction of the opening roller 4. The sliver 2, which is guided to the opening roller 4, is grabbed by the mounting 5 and taken along so that it is deflected around the deflecting edge 15 and is placed on the supporting surface 16. The tuft support 10 is stationarily mounted on member 18 of an opening roller housing 23 (FIG. 2) which, in a manner not shown in detail, surrounds the opening roller 4 and also the feeding roller 1 at least partly and in which the above-mentioned fiber feeding duct starts. Because of the stationary arrangement of the tuft support 10 and because the tuft support 10 contains the deflecting edge 15 for the sliver 2, the position of the deflecting edge 15 and of the supporting surface 16 do not change even when the feeding table 6 carries out compensating movements in an adaptation to the fed sliver 2. As a result, it is ensured that the combing-out conditions also do not change.

The guiding surface 11 of the tuft support 10 is arranged at such a distance from the circumference of the feeding roller 1 that, also when a maximal thickness of the sliver 2 is taken into account, no clamping takes place at this point. As shown in FIG. 1, the guiding surface 8 of the feeding table 6 changes by means of a step into the guiding surface 11 of the tuft support 10 which is situated farther on the outside. The stationary tuft support 10 is adjusted to the optimal combing-out conditions, in which case particularly the position of the tuft with respect to the opening roller 4 and its mounting 5 is determined. This may take place in a simple manner by the fact that, during adjusting operations, instead of an opening roller 4, an adjusting roller is inserted into the feeding and opening device which has a circumference that is larger than the opening roller 4 by the adjusting distance. The tuft support 10 will then be adjusted in such a manner that it rests on the circumference of this adjusting roller, after which it is fixed in this adjusted position.

In order to avoid that fibers or the like are caught or held between the feeding table 6 and the tuft support 10, a sliding gap 12 is provided between the feeding table 6 and the tuft support 10. The feeding table 6 ends with a surface 13 which is cylindrical with respect to its swivel shaft 7 and which is situated opposite a corresponding cylindrical surface 14 of the tuft support 10. As shown particularly in FIG. 2, the feeding table 6 is provided in the area of its cylindrical surface 13 with a recess 21 in the area which is situated opposite the feeding roller 1, this recess 21 serving for the removal of dust particles or the like.

At least the guiding surface 8 of the feeding table 6 and the guiding surface 11, the deflecting edge 15 and the supporting surface 16 of the tuft support 10 have a wear-resistant surface which is obtained by a surface treatment and/or by a coating. In addition, these surfaces are polished to be smooth. The supporting surface 16 of the tuft support 10 is laterally bordered by edge borders 17 so that the end 3 of the sliver 2, the so-called tuft, cannot escape laterally. As a rule, it is provided that the edge borders 17 extend toward one another in a wedge-shape in the direction toward the end of the supporting surface 16.

Figure 3:
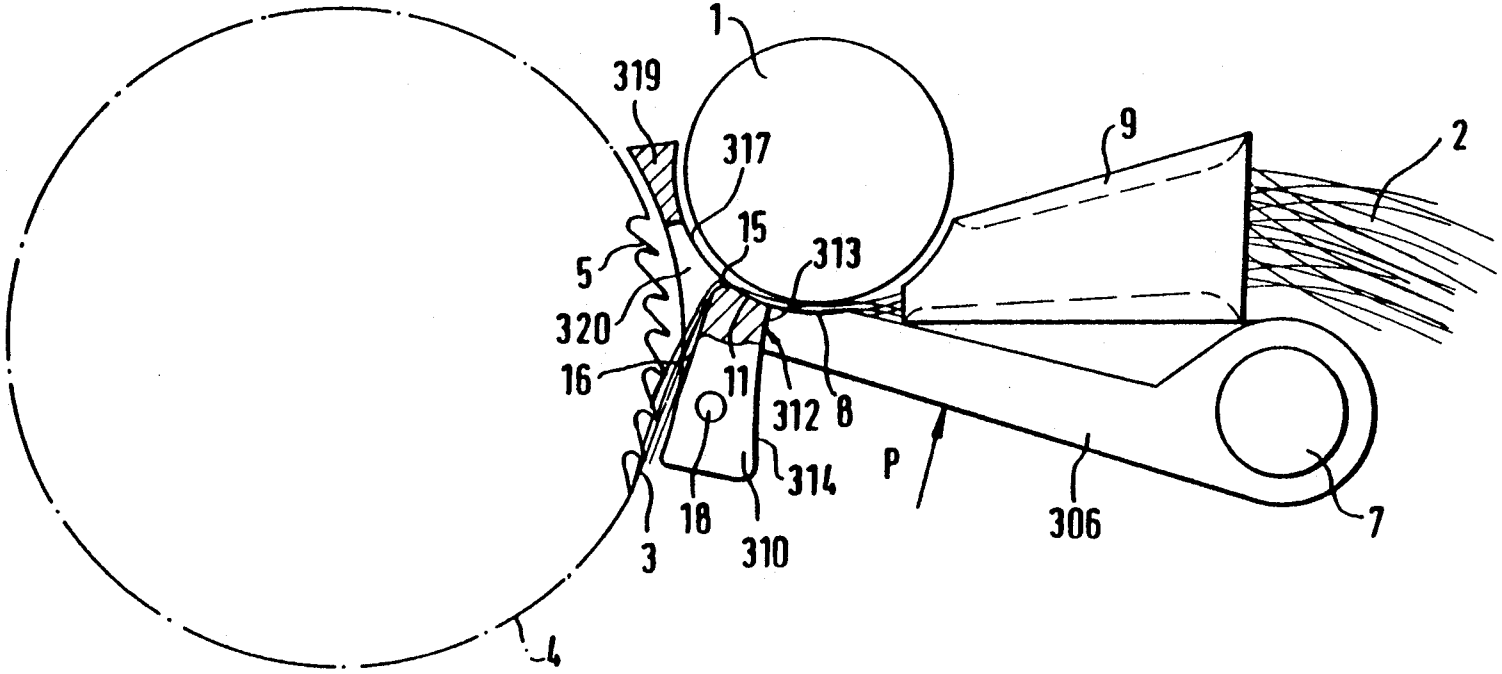
FIG. 3 is a partially sectioned, slightly schematic lateral view of another embodiment of a feeding and opening device according to the invention.

In its basic construction, the embodiment according to FIG. 3 corresponds to the embodiment according to FIGS. 1 and 2. Modifications are provided only in the area of the tuft support 310 which, however, with respect to the function, corresponds to the tuft support 10 according to FIGS. 1 and 2; that is, it has a guiding surface 11 situated opposite the feeding roller 1, as well as a deflecting edge 15 and a supporting surface 16. However, it is provided with a projection 319 which extends against the rotating direction of the opening roller 4 into the area between the feeding roller 1 and the opening roller 4 and which there prevents the development of a disturbing air flow. This projection 319 is held by web-type edge borders 317 so that a type of window 320 is formed through which the sliver 2 is guided to the mounting 5 of the opening roller 4. The edge borders 317 and the projection 319 have contours which, on the one side, are adapted to the circumference of the opening roller 4 and, on the other side, are adapted to the circumference of the feeding roller 1.

Although the invention has been described an illustrated in detail, it is to be clearly understood that the same is by way of illustration and example, and is not to be taken by way of limitation. The spirit and scope of the present invention are to be limited only by the terms of the appended claims.

What is claimed:

1. A feeding and opening device for an open-end spinning arrangement, comprising:

a feeding roller, a movable feeding table which has a feeding surface which forms a clamping point together with the feeding roller, and a tuft support which follows the feeding table and has a supporting surface for a tuft which is situated opposite a mounting of an opening roller, wherein the tuft support is arranged stationarily and has a guiding surface which is situated opposite the feeding roller extending substantially parallel to the circumference of the feeding roller, which guiding surface extends approximately radially with respect to the opening roller and continues the guiding surface of the feeding table and serves to guide substantially all of the sliver supplied to the opening roller.

2. A feeding and opening device according to claim 1, wherein the tuft support can be adjusted relative to the opening roller.

3. A feeding and opening device according to claim 2, wherein the guiding surface of the tuft support, which faces the feeding roller is a partial-cylinder surface which is aligned approximately coaxially with respect to the feeding roller.

4. A feeding and opening device according to claim 3, wherein the supporting surface of the tuft support is provided with edge borders.

5. A feeding and opening device according to claim 4, wherein the tuft support is provided with a projection which projects into the area between the feeding roller and the opening roller and has a window for the guiding-through of a sliver.

6. A feeding and opening device according to claim 5, wherein the guiding surface and the supporting surface of the tuft support are provided with a surface that is resistant to wear.

7. A feeding and opening device according to claim 6, wherein a sliding gap exists between the tuft support and the movable feeding table.

8. A feeding and opening device according to claim 7, wherein the feeding table is disposed so that it can be swivelled about a swivel shaft which is parallel to the feeding roller, and wherein the surfaces of the feeding table and of the tuft support, which face one another, extend at least approximately concentrically with respect to this swivel shaft.

9. A feeding and opening device according to claim 1, wherein the guiding surface of the tuft support, which faces the feeding roller is a partial-cylinder surface which is aligned approximately coaxially with respect to the feeding roller.

10. A feeding and opening device according to claim 1, wherein the supporting surface of the tuft support is provided with edge borders.

11. A feeding and opening device according to claim 1, wherein the tuft support is provided with a projection which projects into the area between the feeding roller and the opening roller and has a window for the guiding-through of a sliver.

12. A feeding and opening device according to claim 1, wherein the guiding surface and the supporting surface of the tuft support are provided with a surface that is resistant to wear.

13. A feeding and opening device according to claim 1, wherein a sliding gap exists between the tuft support and the movable feeding table.

14. A feeding and opening device according to claim 13, wherein the feeding table is disposed so that it can be swivelled about a swivel shaft which is parallel to the feeding roller, and wherein the surfaces of the feeding table and of the tuft support, which face one another, extend at least approximately concentrically with respect to this swivel shaft.

* * * * *